US005415290A

United States Patent [19]

Merkley et al.

[11] Patent Number: 5,415,290

[45] Date of Patent: May 16, 1995

[54] COMIC BOOK PROTECTION COVER SYSTEM

[76] Inventors: John R. Merkley; Cindy L. Merkley, both of 4748 Park Granada #254, Calabasas, Calif. 91302

[21] Appl. No.: 160,267

[22] Filed: Dec. 2, 1993

[51] Int. Cl.[6] ..... B65D 81/04

[52] U.S. Cl. ..... 206/424; 206/45.33; 206/521; 383/40; 383/65; 383/119

[58] Field of Search ..... 383/63, 65, 40, 119, 383/106, 35; 206/424, 521, 45.34, 45.31, 45.33; 40/156, 152.1, 661

[56] References Cited

U.S. PATENT DOCUMENTS

| | | | |
|---|---|---|---|
| 2,518,711 | 8/1950 | Mulford | 206/45.31 |
| 2,728,450 | 12/1955 | Haire | 206/45.33 X |
| 2,728,515 | 12/1955 | Haire | 206/45.33 X |
| 3,011,689 | 12/1961 | Korn et al. | 383/119 |
| 3,338,284 | 8/1967 | Ausnit | 383/65 |
| 3,371,696 | 3/1968 | Ausnit | 383/35 |
| 3,442,372 | 5/1969 | Carmichael | 206/521 X |
| 3,485,697 | 12/1969 | Reed | 383/40 X |
| 4,568,017 | 2/1986 | Grunert | 206/45.33 X |

FOREIGN PATENT DOCUMENTS

| | | | |
|---|---|---|---|
| 0562774 | 9/1993 | European Pat. Off. | 383/65 |

*Primary Examiner*—Bryon P. Gehman

[57] ABSTRACT

An enclosed cover system with a releasable sealing edge for the protection of comic books comprising, a bag formed of thin flexible transparent plastic, the bag having a front sheet and a rear sheet with sealed bottom and side edges and an opened upper slot, the sheets forming a long base and a short width for the receipt of a comic book; and an insert formed of a relatively rigid transparent plastic material the insert having a long height and a short width whereby when positioned within the space of the bag, efficient room will remain for the receipt of a comic book.

1 Claim, 3 Drawing Sheets

FIG. 3
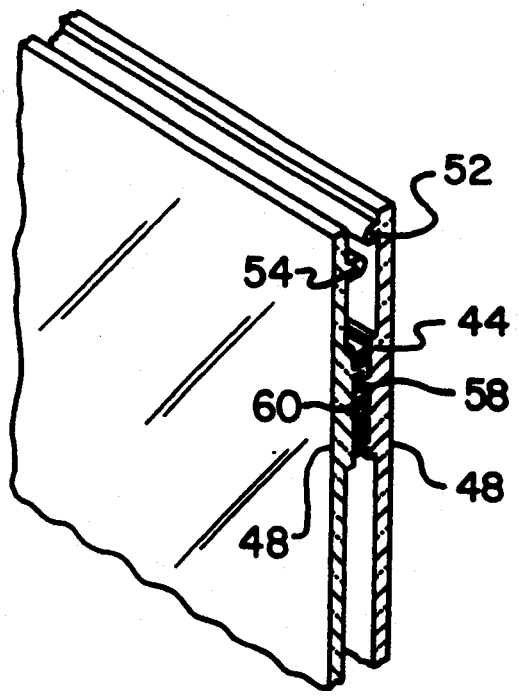
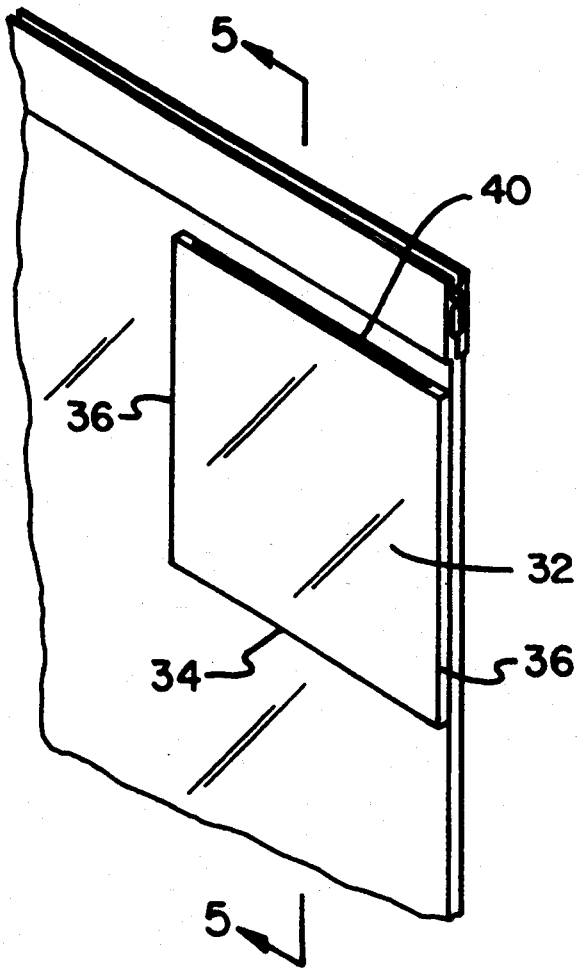
FIG. 4

COMIC BOOK PROTECTION COVER SYSTEM

BACKGROUND OF THE INVENTION

1. Field of the Invention

The present invention relates to comic book protection cover system and more particularly pertains to a transparent bag and rigid insert for the protection of comic books.

2. Description of the Prior Art

The use of protective bags is known in the prior art. More specifically, protective bags heretofore devised and utilized for the purpose of protecting contents are known to consist basically of familiar, expected and obvious structural configurations, notwithstanding the myriad of designs encompassed by the crowded prior art which have been developed for the fulfillment of countless objectives and requirements.

The prior art discloses, for example, U.S. Pat. Nos. 4,603,434 to Herrington; 5,070,584 to Dale and 5,172,980 to Provost which all relate to specifics of locking fingers for an edge of a bag or other containers. In addition, U.S. Pat. Nos. 5,004,514 to Pugliese and 4,515,840 to Gatward disclose sheet material shaped into covers for protecting books or other articles. Lastly, U.S. Pat. No. 3,865,234 to Kester discloses a bag adapted to receive an article for being displayed in combination with a rigid support therefore.

In this respect, the comic book protection cover system according to the present invention substantially departs from the conventional concepts and designs of the prior art, and in so doing provides an apparatus primarily developed for the purpose of protecting comic books.

Therefore, it can be appreciated that there exists a continuing need for new and improved comic book protection cover system. In this regard, the present invention substantially fulfills this need.

SUMMARY OF THE INVENTION

In view of the foregoing disadvantages inherent in the known types of comic book protection cover system now present in the prior art, the present invention provides an improved comic book protection cover system. As such, the general purpose of the present invention, which will be described subsequently in greater detail, is to provide a new and improved comic book protection cover system apparatus and method which has all the advantages of the prior art and none of the disadvantages.

To attain this, the present invention essentially comprises a bag formed of thin flexible transparent polypropylene, the bag having a front sheet and a rear sheet with sealed bottom and side edges and an opened upper slot, the sheets forming a bag of at least 10⅜ inches long and at least 7⅛ inches wide for the receipt of a comic book; an insert formed of a relatively rigid transparent plastic material selected from the class of transparent plastic materials including acrylic, polypropylene, polyethylene and the like, the insert having a height of slightly less than 10⅜ inches and a width of slightly less than 7⅛ inches whereby when positioned within the space of the bag, sufficient room will remain for the receipt of a comic book; a pocket of a flexible transparent polyethylene, the pocket having a sheet with sealed bottom and side edges coupled to the bag and an opened upper slit forming an opening to receive indicia related to the comic book being held within the space, the pocket being of a size to cover only a portion of the front sheet; a closure for the space of the bag formed adjacent to the upper slot and above the space of the bag, the closure including a thickened portion of the bag, the thickened portion having opposed long spreader fingers facing each other across the opening at a short distance from the upper edge of the front sheet and rear sheet, the thickened portion also having oppositely facing locking fingers spaced a distance from the upper edge of the bag a greater distance for releasible sealing the contents of the bag.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved comic book protection cover system which has all the advantages of the prior art bags and none of the disadvantages.

It is another object of the present invention to provide a new and improved comic book protection cover system which may be easily and efficiently manufactured and marketed.

It is a further object of the present invention to provide a new and improved comic book protection cover system which is of a durable and reliable construction.

An even further object of the present invention is to provide a new and improved comic book protection cover system which is susceptible of a low cost of manufacture with regard to both materials and labor, and which accordingly is then susceptible of low prices of sale to the consuming public, thereby making such comic book protection cover system economically available to the buying public.

Still yet another object of the present invention is to provide a new and improved comic book protection cover system which provides in the apparatuses and methods of the prior art some of the advantages thereof, while simultaneously overcoming some of the disadvantages normally associated therewith.

Still another object of the present invention is to protect comic books.

Yet another object of the present invention is to cover comic books for their protection and display.

Even still another object of the present invention is to provide a new and improved an enclosed cover system with a releasable sealing edge for the protection of comic books comprising a bag formed of thin flexible transparent plastic, the bag having a front sheet and a rear sheet with sealed bottom and side edges and an opened upper slot, the sheets forming a long base and a short width for the receipt of a comic book; and an insert formed of a relatively rigid transparent plastic material the insert having a long height and a short width whereby when positioned within the space of the bag, efficient room will remain for the receipt of a comic book.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a sectional view taken along line 3—3 of FIG. 2.

FIG. 4 is an enlarged perspective view of a portion of an edge of a bag similar to FIGS. 1 and 2 but constructed in accordance with an alternate embodiment of the invention.

DESCRIPTION OF THE PREFERRED EMBODIMENT

Figure 1:
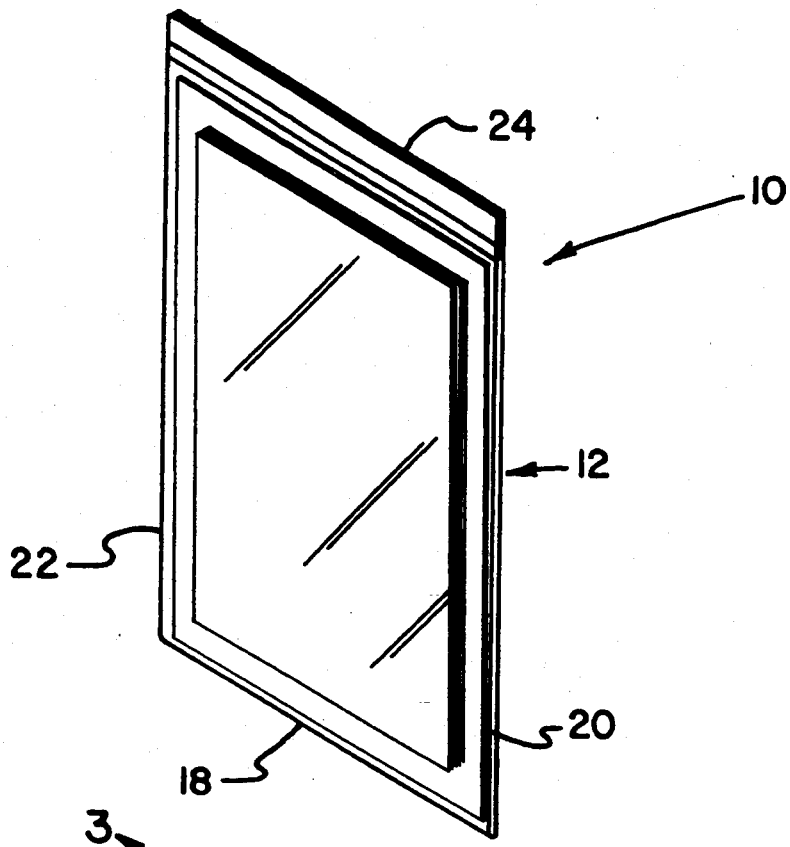
FIG. 1 is a perspective illustration of the bag constructed in accordance with the principles of the present invention for use with the comic book protection cover system.
Figure 2:
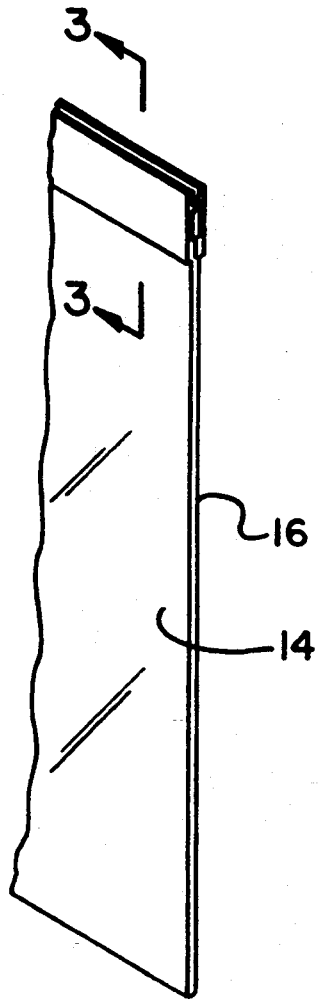
FIG. 2 is an enlarged prospective illustration of one edge of the bag shown in FIG. 1.
Figure 5:
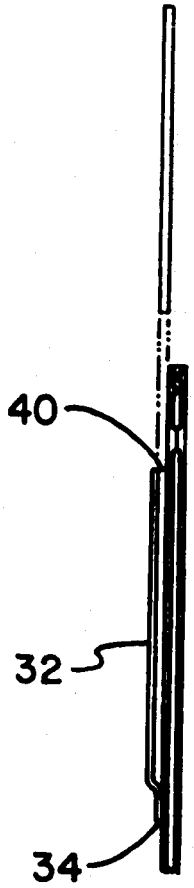
FIG. 5 is a sectional view of the comic book protection cover system taken along line 5—5 of FIG. 4.
Figure 6:
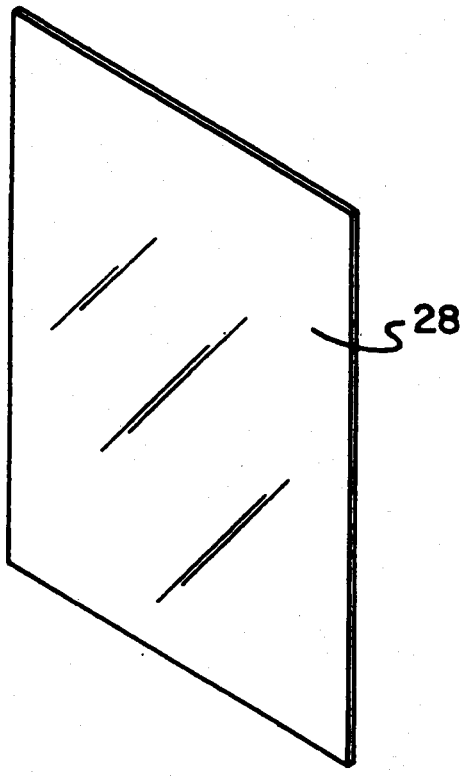
FIG. 6 is a perspective view of the insert card as shown in FIG. 5.

With reference now to the drawings, and in particular to FIG. 1 thereof, a new and improved comic book protection cover system embodying the principles and concepts of the present invention and generally designated by the reference numeral 10 will be described.

More specifically, it will be noted that the cover system 10 is for the protection of comic books and like articles. The system comprises, in combination, a bag 12 formed of thin flexible transparent plastic, preferably polypropylene. The bag 12 has a front sheet 14 and a rear sheet 16. The sheets have sealed bottom 18 and side edges 20 and 22. They also form an opened upper slot 24. The sheets form a bag of at least 10⅜ inches long and at least 7⅛ inches wide for the receipt of a comic book.

Used in association with the bag 12 is an insert 28. The insert 28 is formed of a relatively rigid transparent plastic material. The plastic material is preferably selected from the class of transparent plastic materials including acrylic, polypropylene, polyethylene and the like. The insert has a height of slightly less than 10⅜ inches and a width of slightly less than 7⅛ inches. In this manner, when the insert 38 is positioned within the space of the bag 12, sufficient room will remain for the receipt of a comic book to be protected.

Formed onto the bag 12 is a pocket 32. The pocket is fabricated of a flexible transparent plastic, preferably polyethylene. The pocket 32 is formed of a sheet with sealed bottom 34 and side edges 36. It has an opened upper slit 40 forming an opening to receive indicia related to the comic book being held within the space. The pocket is of a size to cover only a portion of the front sheet. One side edge of the pocket 32 overlies or side edge of the bag 12.

A closure 44 for the space of the bag is formed adjacent to the upper slot 24. This is above the space of the bag. The closure includes a thickened portion 48 of the bag. The thickened portion 48 has opposed long spreader fingers 52 and 54 facing each other across the opening 24. This is located at a short distance from the upper edge of the front sheet and rear sheet.

The thickened portion 48 also has oppositely facing locking fingers 58 and 60. Such fingers are spaced a distance from the upper edge of the bag a greater distance than the spreader fingers 52 and 54. The locking fingers function for releasible sealing the contents of the bag.

The locking fingers 58 and 60 are a plurality of outwardly facing extensions on the front face and on the back face of the bag 12. The locking fingers act to seal and protect a comic book in the bag 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. In combination with a comic book, an enclosed cover system with a releasable sealing edge for the protection of the comic book comprising, in combination, a bag formed of thin flexible transparent polypropylene, the bag having a front sheet and a rear sheet with sealed bottom and side edges and an opened upper slot, the sheets forming a bag having an internal space therein of at least 10⅜ inches long and at least 7⅛ inches wide for the receipt of the comic book;

a rectangular insert formed of a relatively rigid transparent plastic material, the inset having a height of slightly less than 10⅜ inches and a width of slightly less than 7⅛ inches and positioned within the internal space of the bag so that sufficient room remains for the comic book;

a pocket of a flexible transparent polyethylene, the pocket having a sheet with sealed bottom and side edges coupled to the bag and an opened upper slit forming an opening to receive indicia related to the comic book, the pocket being of a size to cover only a portion of the front sheet with one side edge of the pocket overlying one side edge of the bag; and a closure for the internal space of the bag formed adjacent to the upper slot and above the internal space of the bag, the closure including a thickened portion of the bag, the thickened portion having opposed long spreader fingers facing each other across the opening at a distance from the upper edge of the front sheet and rear sheet, the thickened portion also having oppositely facing locking fingers spaced a distance from the upper edge of the bag, the second distance being greater than the first distance for releasable sealing of the contents of the bag.

* * * * *